US006267494B1

(12) United States Patent
Burch

(10) Patent No.: US 6,267,494 B1
(45) Date of Patent: Jul. 31, 2001

(54) WARNING SYSTEM FOR A CHARGE HOPPER

(76) Inventor: Leon A. Burch, 11 Christy La., Naugatuck, CT (US) 06770

( * ) Notice: Subject to any disclaimer, the term of this patent is extended or adjusted under 35 U.S.C. 154(b) by 0 days.

(21) Appl. No.: 09/523,641

(22) Filed: Mar. 10, 2000

(51) Int. Cl.[7] ..... B28C 7/16

(52) U.S. Cl. ..... 366/41; 366/68; 141/94; 116/28 R; 116/200; 116/303

(58) Field of Search ..... 116/28 R, 200, 116/303; 298/24 M–35 M; 366/41, 68; 193/DIG. 2, 117; 414/698, 683, 148; 141/94; 340/438, 457, 686.1, 686.2, 689

(56) References Cited

U.S. PATENT DOCUMENTS

| | | | |
|---|---|---|---|
| 2,571,113 | * | 10/1951 | Crosby . |
| 4,065,751 | | 12/1977 | Stewart et al. . |
| 4,261,616 | | 4/1981 | Beegle . |
| 4,276,975 | * | 7/1981 | Jenkins . |
| 4,418,636 | * | 12/1983 | Piper . |
| 4,428,677 | * | 1/1984 | Schreiter . |
| 4,682,145 | | 7/1987 | Brawner, Jr. . |
| 4,967,182 | | 10/1990 | Foster . |
| 4,988,974 | | 1/1991 | Fury et al. . |
| 5,251,967 | | 10/1993 | Eberling . |
| 5,405,181 | | 4/1995 | Watkins et al. . |
| 5,421,600 | | 6/1995 | Jones et al. . |
| 5,433,296 | | 7/1995 | Webberley . |
| 5,477,207 | | 12/1995 | Frame, Sr. et al. . |
| 5,607,221 | | 3/1997 | Justus . |
| 5,625,335 | | 4/1997 | Kelly . |
| 5,678,505 | | 10/1997 | Leung et al. . |

* cited by examiner

*Primary Examiner*—Joseph W. Drodge
*Assistant Examiner*—Terry K. Cecil
(74) *Attorney, Agent, or Firm*—Cummings & Lockwood

(57) ABSTRACT

A warning system is disclosed for use on a concrete mixer to indicate that a charge hopper 28 is in a raised position. Such concrete mixers include an air supply, a mixing drum having an access port, a frame supporting the mixing drum, and a charge hopper 28 that is pivotally supported adjacent the access port. The charge hopper 28 is moveable between a raised position and a lowered position. The warning system includes an indicator device 70 operatively associated with the concrete mixer and configured for activation to indicate when the charge hopper is in the raised position. A valve 44 is operatively associated with the frame and in fluid communication with the air supply 14 and the indicator device 70. The valve 44 includes an actuator moveable between a first position to deactivate the indicator device and a second position to activate the indicator device. A contact structure 50 is operatively associated with the charge hopper to actuate the valve.

8 Claims, 5 Drawing Sheets

WARNING SYSTEM FOR A CHARGE HOPPER

BACKGROUND OF THE INVENTION

1. Field of the Invention

The subject invention relates generally to a warning system for a charge hopper, and, more particularly, to a warning system for use on mobile-type concrete mixers to signal the operators thereof when the concrete mixers' charge hoppers are in a raised position.

2. Background of the Related Art

Mobile-type concrete mixers are the workhorse in the building industry. There are tens-of-thousands of such concrete mixers in operation today throughout the world. Their basic function is to mix and deliver tons of concrete to a variety of settings including residential and industrial construction sites. Mobile-type concrete mixers can be classified into two groups—tractor-carried concrete mixers and tractor-drawn concrete mixers.

The tractor-carried concrete mixers have two basic configurations. They include a conventional configuration which is loaded and delivers concrete from the rear of the vehicle and a front-loader configuration which, as the name implies, is loaded and delivers concrete from the front of the vehicle. Although configured differently, they share similar characteristics. That is, they each include a cab for the operator to drive the vehicle, an air supply system, a mixing drum, frames to support the mixing drum, a charge hopper, and controls for operating the mixing drum and charge hopper.

Tractor-drawn concrete mixers basically comprise a trailer-mounted concrete mixer that is pulled by a tractor. They tend to have a larger capacity then tractor-carried concrete mixers and are often used for large pours such as found in highway and dam construction. Although configured somewhat differently then the tractor-carried concrete mixers, tractor-drawn concrete mixers share similar characteristics. That is, they include a cab in the tractor for the operator to drive the vehicle, an air supply system, a mixing drum, frames to support the mixing drum, a charge hopper, and controls for operating the mixing drum and charge hopper.

Both tractor-carried concrete mixers and tractor-drawn concrete mixers may alternatively be referred to simply as concrete mixers. To simplify the description of the present invention, reference will be made only to tractor-carried cement mixers. Those skilled in the art will appreciate that the present invention will benefit any and all types of mobile-type concrete mixers.

Referring to FIGS. 1 and 2, a perspective view of a conventional tractor-carried concrete mixer designated by reference numeral 10 and an elevational view of a rear portion of the concrete mixer 10 are illustrated, respectively. In the descriptions provided herein below, like reference numerals identify similar structural elements.

As noted above, a tractor-carried concrete mixer 10 includes a cab 12 that provides a protective enclosure in which the operator drives the truck and controls various functions of the concrete mixer. Concrete mixer 10 also includes an air supply system that provides compressed air for actuating a breaking system, for actuating pneumatic cylinders, and for general-purpose usage. The air supply system includes a compressor that is driven by the tractor's engine and charges a volume tank 14 to store compressed air for the above-described purposes.

Concrete mixer 10 further includes a mixing drum 16 for mixing and storing cement, aggregate, and water, i.e., concrete. The mixing drum 16 has a closed end and an open end. The open end is an access port 18 through which cement, aggregate, and water are poured into the interior of the mixing drum 16 and out of which concrete is poured.

The controls 19 are typically located within eyeshot of the access port 18 to enable an operator to manipulate the controls 19 while observing delivery of concrete from the mixing drum 16. The type and number of controls 19 vary from concrete mixer to concrete mixer. However, all concrete mixers include a control to operate the mixing drum 16, and to raise and lower the charge hopper as described in more detail herein below.

The mixing drum 16 is rotationally supported by a set of frames including a cab-side frame 20 and a hopper-side frame 22. The cab-side frame 20 supports the closed end of the mixing drum 16 through a tapered roller bearing (not shown). The hopper-side frame 22 supports the open end of the mixing drum 16 through a pair of rollers (not shown) that ride against a support ring 24 attached to the mixing drum 16. Extending from the upper portion of the hopper-side frame 22 is a near-side vertical support 26 and a complementary far-side vertical support (not shown).

The charge hopper 28 is funnel-shaped and is utilized in a lowered position to guide cement, aggregate, and water from storage containers at a concrete plant, through the access port 18, and into the mixing drum 16. The charge hopper 28, when moved to a raised position, allows concrete to pour unobstructed from the mixing drum 16, out through the access port 18, down a chute attachment 30 (shown in its stored position), and into, for example a pour frame.

The near-side vertical support 26 and far-side vertical support provide mounting points for the charge hopper 28. More specifically, the charge hopper 28 is pivotally mounted by a near-side pivot pin 32 to a near-side attachment arm 34 which is attached to the near-side vertical support 26, and a complementary far-side pivot pin to a far-side attachment arm (not shown) which is attached to the far-side vertical support.

A first end 38 of a pneumatic lift cylinder 36 is mounted to the near-side vertical support 26 and a second end 40 is mounted to the charge hopper 28 for pivoting the charge hopper 28 between the lowered position and the raised position. That is, the charge hopper 28 is pivoted from the lowered position to the raised position by extending the pneumatic lift cylinder 36, thereby pivoting the charge hopper 28 in the counter-clockwise direction about the pivot pins as indicated by the "Y" arrow (FIGS. 1 and 3). The charge hopper 28 is pivoted from the raised position to the lowered position by retracting the pneumatic lift cylinder 36, thereby pivoting the charge hopper 28 in the clockwise direction about the pivot pins as indicated by the "X" arrow (FIGS. 1 and 2). The charge hopper 28, illustrated in FIGS. 1 and 3. is shown in the raised position while the charge hopper 28 illustrated in FIG. 2 is shown in the lowered position. Although the lift cylinder 36 is described herein as a "pneumatic" lift cylinder, such lift cylinders might also be hydraulically operated.

Those skilled in the art will appreciate that when the charge hopper 28 is in the raised position it increases the overall height of the tractor-carried concrete mixer 10 by approximately one to two feet. Therefore, proper operation of the concrete mixer 10 dictates that the charge hopper 28 should be located in the lowered position any time the vehicle is traveling over roadways; thereby preventing it from accidentally hitting low overpasses, power cables, light poles, etc., and causing severe property damage and personal injury. However, due to a wide variety of distractions found at construction sites, it is relatively easy for an operator to forget that the charge hopper is in the raised position.

It would be beneficial to provide a system to warn an operator of a tractor-carried concrete mixer or tractor-drawn concrete mixer that the charge hopper is in the raised position. Such a system should be relatively inexpensive, easy to install, operate and maintain.

SUMMARY OF THE INVENTION

The subject invention is directed to a warning system for use on a concrete mixer that includes an air supply, a mixing drum having an access port, and a charge hopper pivotally supported adjacent the access port, wherein the charge hopper is mounted for movement between a raised position and a lowered position.

An embodiment of the warning system includes an indicator device operatively associated with the concrete mixer and configured to be activated to indicate when the charge hopper is in the raised position. A valve is operatively associated with the concrete mixer and in communication with the air supply and the indicator device. The valve includes an actuator moveable between a first position to deactivate the indicator device and a second position to activate the indicator device. A contact structure is operatively associated with the charge hopper to actuate the valve. In use, pressurized air is transmitted from the air supply to the indicator device when the actuator of the valve is in the first position. The indicator device may be a diaphragm-type indicator having a warning arm that pivots into the field of vision of an operator when it is activated.

Another embodiment of the present invention includes a kit for mounting on a concrete mixer to indicate when a charge hopper is in a raised position. The kit includes at least one conduit, an indicator device configured to be activated to indicate when the charge hopper is in the raised position, a valve configured to communicate with an air supply and the indicator device through the at least one conduit, wherein the valve includes an actuator moveable between a first position to deactivate the indicator device and a second position to activate the indicator device, and a contact structure configured to actuate the valve. The kit may be packaged in any type of packaging available on the market. For example, the packaging may be a box with formed inserts to support its contents.

Another embodiment of the present invention includes a method for indicating when a charge hopper is in a raised position on a concrete mixer. Preferably, the method includes the step of providing an indicator device operatively associated with the concrete mixer and a valve operatively associated with the concrete mixer and in communication with an air supply and the indicator device, the valve including an actuator moveable between a first position to deactivate the indicator device and a second position to activate the indicator device. The method further includes the steps of pivoting the charge hopper to the raised position, actuating the valve to move the actuator from the first position to the second position, and activating the indicator device to indicate the charge hopper is in the raised position.

These and other unique features of the present invention generally described as a warning system for a charge hopper will become more readily apparent from the following drawings and description thereof.

BRIEF DESCRIPTION OF THE DRAWINGS

So that those of ordinary skill in the art to which the subject invention appertains will more readily understand how to make and use the invention described herein, preferred embodiments of the invention will be described in detail herein below with reference to the drawings wherein.

DETAILED DESCRIPTION OF THE PREFERRED EMBODIMENTS

Figure 1:
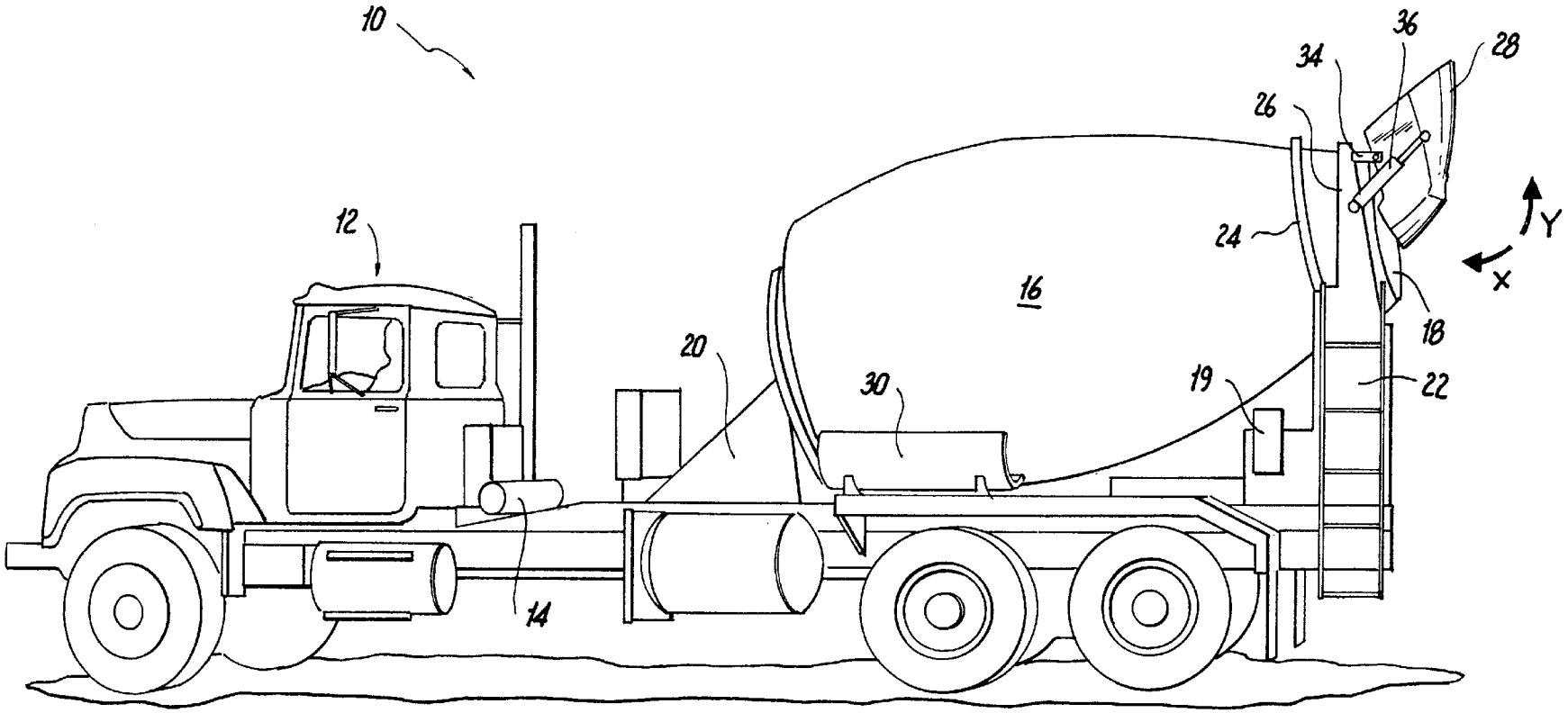
Fig. 1 (Prior Art)
FIG. 1 is a perspective view of a tractor-carried concrete mixer having a charge hopper in a raised position.

As described above in reference to FIGS. 1–3, a typical tractor-carried concrete mixer 10 includes a cab 12 for an operator to drive the vehicle, an air supply system, a mixing drum 16, a set of frames 20 and 22 to support the mixing drum 16, and a charge hopper 28. The charge hopper 28 is moved to a lowered position so cement, aggregate, and water may be poured into the upper portion of the charge hopper 28 as shown by arrow "Z" (FIG. 2), funneled through the access port 18, and dumped into the mixing drum 16. The charge hopper 28 is moved to a raised position to allow concrete to pour unobstructed from the mixing drum 16, down a chute attachment 30 (shown in its stored position), and poured into, for example, a pour frame.

Figure 2:
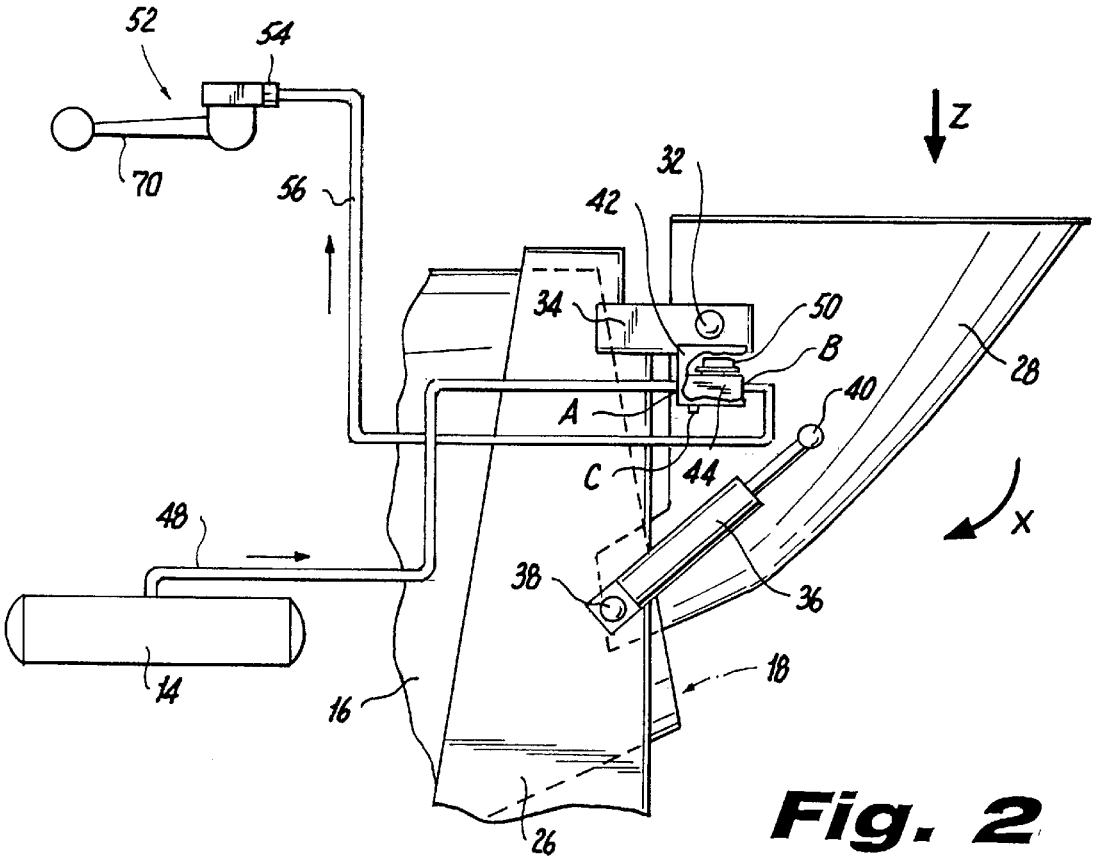
FIG. 2 is a side elevational view of a rear portion of a tractor-carried concrete mixer that includes an embodiment of the present invention.
Figure 3:
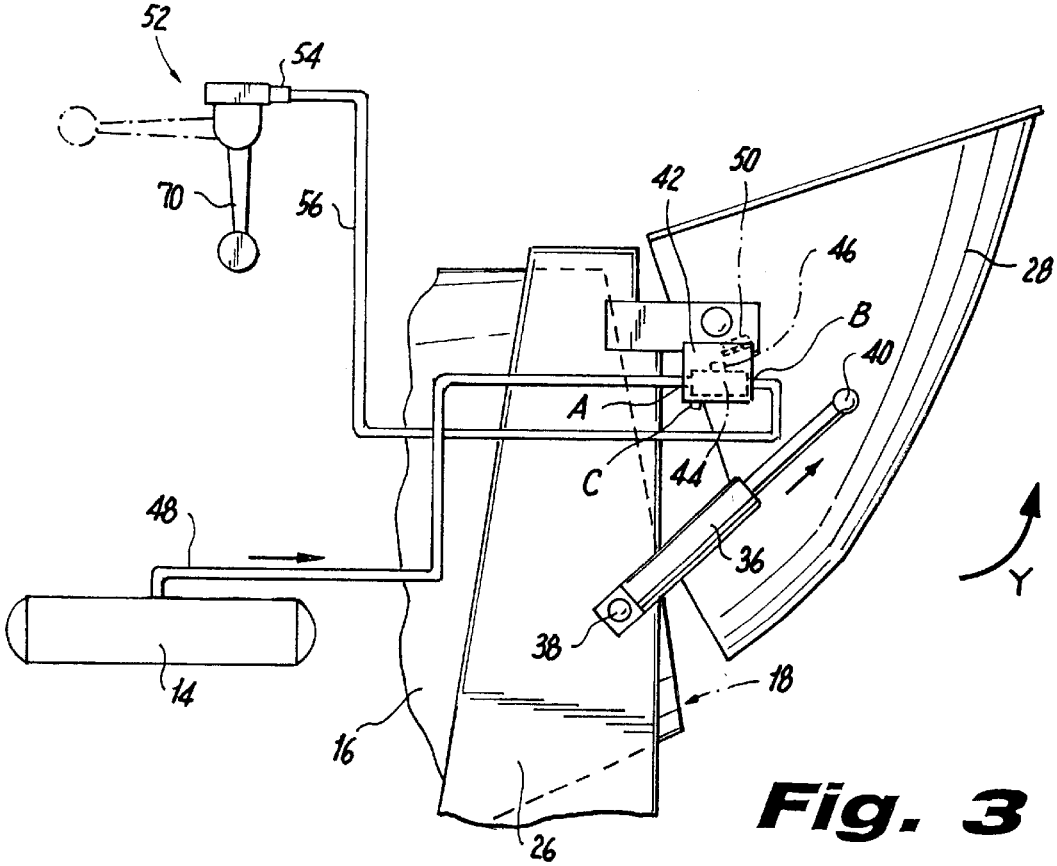
FIG. 3 is a side elevational view of a rear portion of a tractor-carried concrete mixer that includes an embodiment of the present invention.

Referring in particular to FIGS. 2 and 3. an embodiment of the present invention is illustrated. The embodiment is assembled to the tractor-carried concrete mixer 10. A detailed description of the embodiment follows herein below. As noted above, although the description provided herein and the figures referred to concern a tractor-carried concrete mixer, the present invention may be utilized on any mobile-type concrete mixer.

A mounting bracket 42 is mounted to the near-side attachment arm 34. A valve 44 is mounted to the mounting bracket 42 with its actuator 46 facing upward. The valve 44 can alternatively be described as a switching device. The mounting bracket 42 may be made adjustable with respect to the near-side attachment arm 34, for example, by including slots in the mounting bracket 42 and using screws to secure it in place. In addition, the valve 44 may be made adjustable with respect to the mounting bracket 42, for example, by including slots in the mounting bracket 42 and using screws to secure the valve 44 in place. It is notable that the mounting bracket 42 and valve 44 may in the alternative be mounted to the charge hopper 28. Circumstances relating to a particular installation will dictate the most preferable mounting location.

Figure 4:
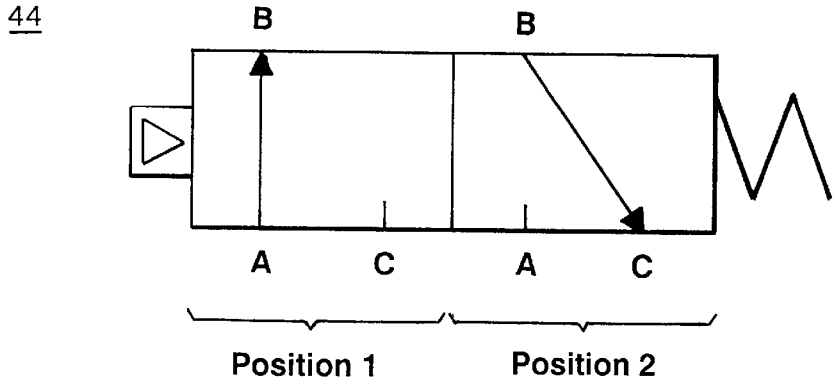
FIG. 4 is a schematic view of a two-position, three-port valve used in an embodiment of the present invention.

Referring to FIG. 4, as illustrated schematically, the valve 44 is a plunger actuated, two-position, three-port type pneumatic valve. The three ports are identified as port "A", port "B", and port "C". In position 1, wherein the plunger is depressed, an air passage is formed between port "A" and port "B". In position 2, wherein the plunger is released to allow a spring to act within the valve, an air passage is formed between port "B" and port "C". Those skilled in the art will appreciate that other types of valves may be used in the present embodiment without departing from the breath and scope of the invention.

Referring again to FIGS. 2 and 3, a supply conduit 48 provides fluid communication between the volume tank 14 and port "A" of the valve 44. The supply conduit 48 may be made of rigid tubing, flexible tubing, or a combination of both. Circumstances relating to a particular installation will dictate the most preferable types of materials to use.

A contact structure 50 is mounted to the charge hopper 28. The contact structure 50 may be made adjustable with respect to the charge hopper 28, for example, by including slots in the contact structure 50 and using screws to secure it in place. The contact structure 50 is positioned on the charge hopper 28 so that it depresses the plunger actuator 46 when the charge hopper 28 is in the lowered position (FIG. 2) and releases the plunger actuator 46 when the charge hopper 28 is in the raised position (FIG. 3). The term "raised position" shall be interpreted broadly to include any position other than the lowered position.

It is notable that if the mounting bracket 42 and valve 44 are mounted to the charge hopper 28 as described above, then the contact structure 50 would be mounted to, for example, the near side attachment arm 34 so that it will function to actuate the plunger actuator 46 as described above. It is also notable that the contact structure 50 may be configured to actuate any type of actuator 46 available such as a lever actuator, magnetic actuator, etc. If, for example the actuator is a magnetic actuator, then the contact structure 50 may simply be a portion of the charge hopper 28 which has magnetic properties sufficient to activate the valve 44.

A low-pressure indicator 52 ("L.P. indicator") is mounted to the tractor-carried concrete mixer 10 in a location that is conspicuous to the operator when he is preparing to move the vehicle. The L.P. indicator is a diaphragm-type indicator. Generally, regardless of the particular configuration, indicators are considered to be "activated" when they signal an operator that the charge hopper is in the raised position, and "deactivated" when the signal is removed or disabled. The L.P. indicator 52 includes an inlet connector 54 for attaching a conduit. Although in most cases it may be preferable to locate the L.P. indicator 52 in the cab 12, under certain circumstances it may be preferable to locate it, for example, near the driver's-side door handle of the cab 12 or near the concrete mixer controls 19 (FIG. 1).

A signal conduit 56 provides fluid communication between port "B" of the valve 44 and the inlet connector 54. The signal conduit 56 may be made of rigid tubing, flexible tubing, or a combination of both. Circumstances relating to a particular installation will dictate the most preferable types of materials to be used.

Figure 5:
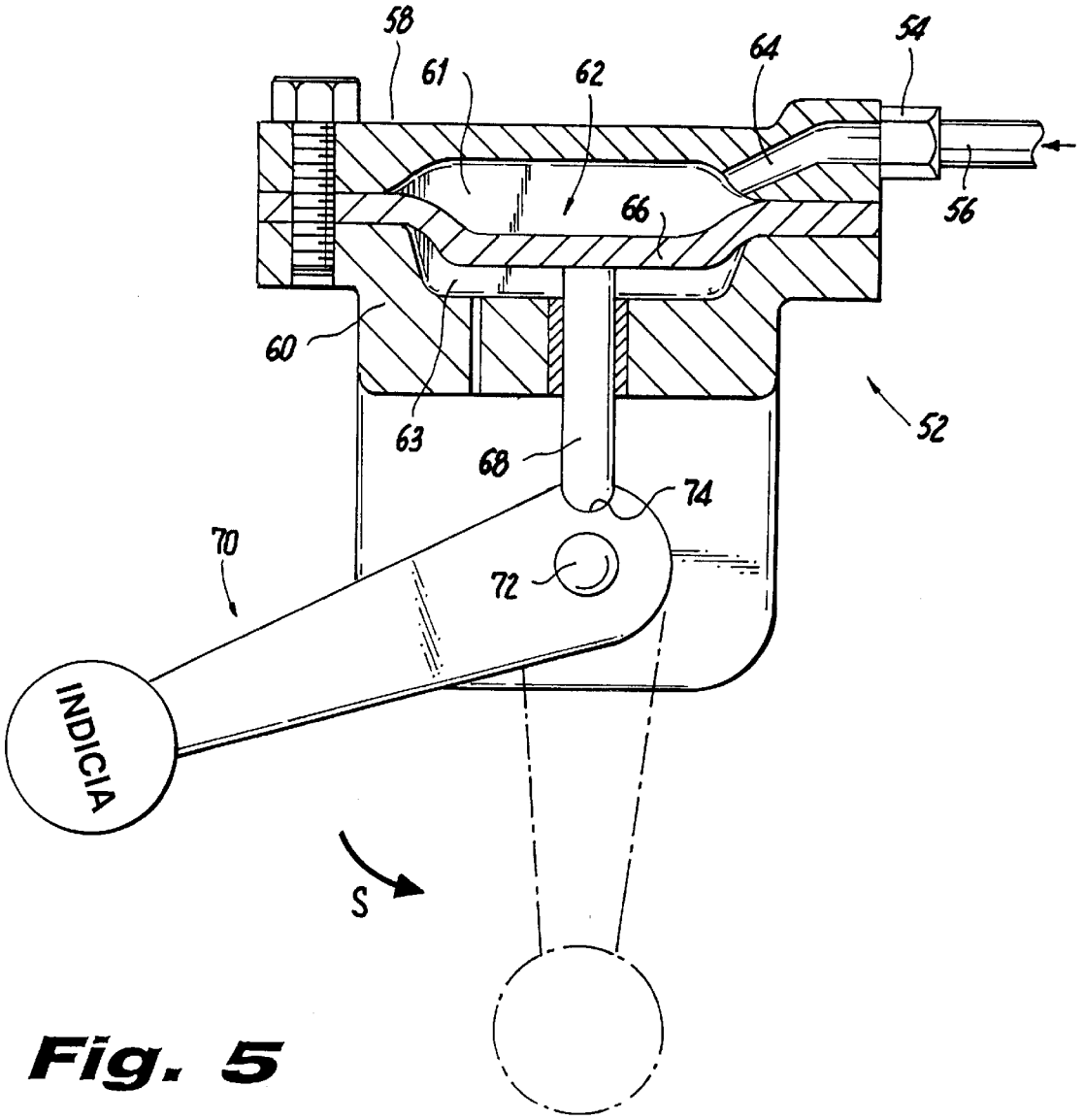
FIG. 5 is a side elevational view in cross section of a low-pressure indicator.

Referring to FIG. 5, the L.P. indicator 52 is shown to include an upper housing 58 and a lower housing 60. A cavity 62 is formed there between. An air channel 64 extends between the inlet connector 54 and the cavity 62. A diaphragm 66 is sandwiched between the upper housing 58 and lower housing 60, thereby dividing the cavity 62 into an upper chamber 61 and a lower chamber 63. A pin 68 extends from the diaphragm and through the lower housing 60. A warning arm 70 is pivotally mounted by a dowel 72 to the lower housing 60 at a point proximate the pin 68. The warning arm 70 includes a detent 74 that aligns with the pin 68 when the warning arm 70 is in the raised position as shown.

The pin 68 engages the detent 74 when air pressure is applied via the signal conduit 56 and air channel 64 to the upper chamber 61 of the cavity 62. The pin 68 disengages the detent 74 when air pressure is removed from the upper chamber 61 of the cavity 62. At such time, the warning arm 70 swings down in counter-clockwise direction as illustrated by arrow "S" to the lowered position (shown in dotted lines). An L.P. indicator that may be used in the present embodiment is the Wig-Wag® low air pressure indicator (part no. 900–0202) manufactured by Stemco Manufacturing Company (Longview, Tex.).

Figure 6:
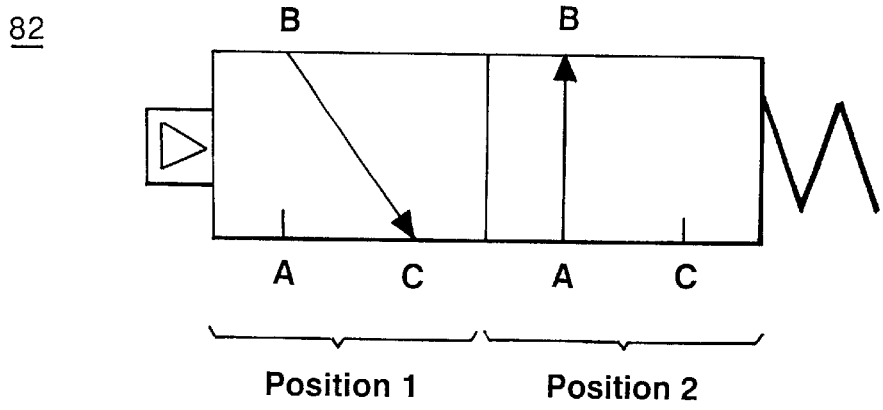
FIG. 6 is a side elevational view in cross section of an alternate type of indicator.

Referring to FIG. 6, an alternate type of indicator 76 is illustrated. The indicator 76 is similar to the L.P. indicator 52, however, it includes a spring 78 in upper chamber 61 for biasing the diaphragm 66 and the pin 68 downwardly to engage the detent 74. In addition, the indicator 76 does not include the air channel 64, but instead includes an air channel 80 for emitting air pressure from the signal conduit 56 to the lower chamber 63. When air pressure is emitted to lower chamber 63. the diaphragm 66 and the pin 68 are urged upwardly to disengage the pin 68 from the detent 74 and allow the warning arm 70 to drop down to the lower position. Those skilled in the art will appreciate that other types of pressure sensitive indicators may be used in the present embodiment without departing from the breath and scope of the invention.

Figure 7:
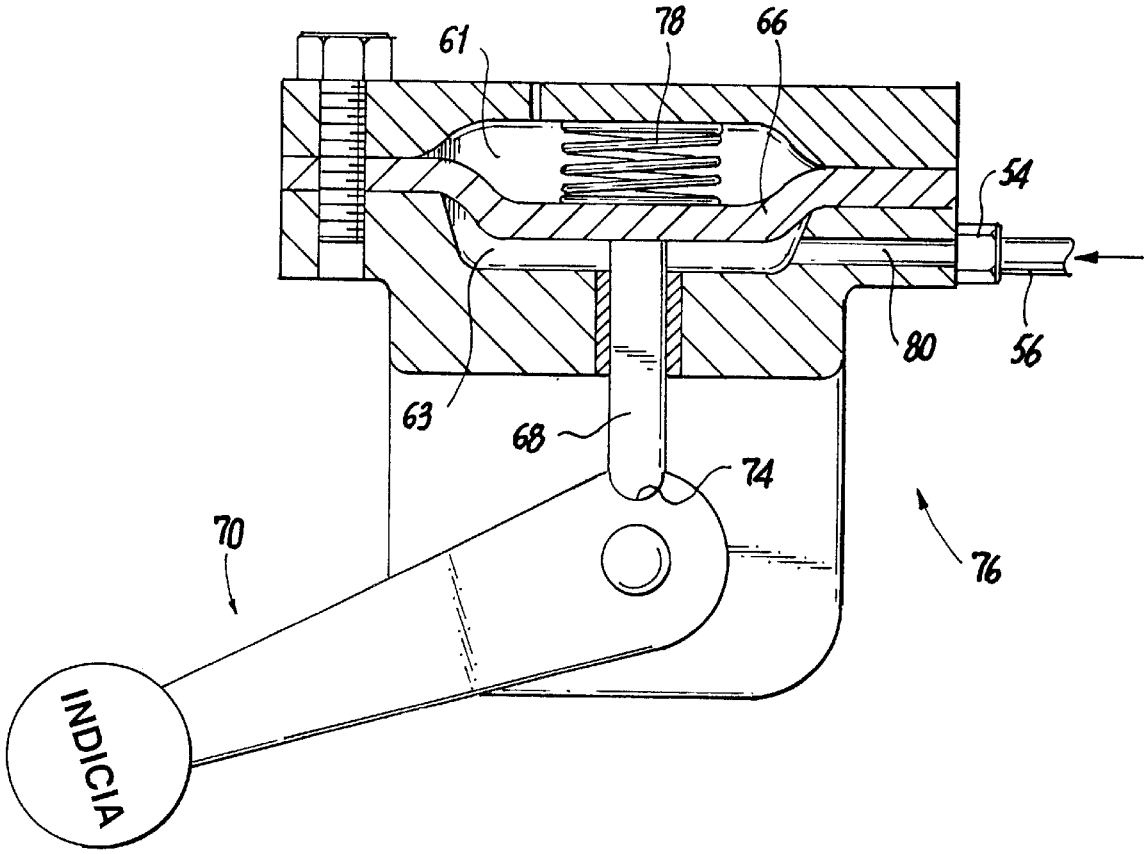
FIG. 7 is a schematic view of a two-position, three-port valve used in an embodiment of the present invention.

Referring to FIG. 7, a schematic for a valve 82 that may be used with the alternate type of indicator 76 is illustrated. The valve 82 is a plunger actuated, two-position, three-port type pneumatic valve. The three ports are identified as port "A", port "B", and port "C". In position 1, wherein the plunger is depressed, an air passage is formed between port "B" and port "C". In position 2, wherein the plunger is released to allow a spring to act within the valve, an air passage is formed between port "A" and port "B".

Referring to FIGS. 1–5, in operation, an operator of the tractor-carried concrete mixer 10 prepares to deliver concrete to a construction site. The tractor-carried concrete mixer 10 includes an embodiment of the present invention. The embodiment utilizes indicator 52 and valve 44.

In preparation, the volume tank 14 is charged with air pressure and the charge hopper 28 is moved to the lowered position. While the charge hopper 28 pivots clockwise to the lowered position as indicated by arrow "X" in FIGS. 1 and 2, the contact structure 50 contacts and depresses the plunger actuator 46 of valve 44. At such time, the valve 44 is switched from position 2 to position 1 (FIG. 4) and pressurized air is provided from volume tank 14 through supply conduit 48, valve 44, signal conduit 56, and to L.P. indicator 52. With pressurized air applied to L.P. indicator 52, the diaphragm 66 extends the pin 68 downward. The operator then swings the warning arm 70 up into the raised position so that the pin 68 engages the detent 74 and maintains the warning arm 70 in the raised position as illustrated in FIGS. 2 and 5. The operator is then certain that the charge hopper 28 is in the lowered position and that he can safely travel to the construction site.

After arriving at the construction site, but before pouring the concrete, the operator raises the charge hopper 28 utilizing the controls at the control panel 19. While the charge hopper 28 pivots counter-clockwise to the raised position as indicated by arrow "Y" in FIGS. 1 and 3, the contact structure 50 releases the plunger actuator 46 of valve 44. At such time, the valve 44 is switched from position 1 to position 2, the pressurized air from supply conduit 48 is closed off at port "A", and the pressurized air in the L.P.

indicator 52 and the signal conduit 56 is bled off through port "C" of valve 44. With pressurized air removed from the L.P. indicator 52, the diaphragm 66 moves upwardly to disengage the pin 68 from the detent 74. The warning arm 70 then swings downward in the counter-clockwise direction (as illustrated by arrow "S") to the lowered position as illustrated in FIGS. 3 and 5.

When the operator has finished pouring concrete and he is ready to leave the construction site, he may in haste jump into the cab 12 of the tractor-carried concrete mixer 10 without lowering the charge hopper 28. As noted above, traveling over roadways with the charge hopper 28 in the raised position can cause severe property damage and personal injury. Assuming, for example, that the L.P. indicator 52 is installed in a position in the cab 12 so that the warning arm 70 is in the operator's forward field of vision when it is in the lowered position, the operator will immediately recognize that the charge hopper 28 is still in the raised position. At such time, the operator returns to the control panel 19 and lowers the charge hopper 28. After the charge hopper 28 is lowered, the operator returns to the cab 12, raises the warning arm 70, and safely leaves the construction site.

To utilize the present invention on tractor-drawn concrete mixers, some modifications to the above-described system may be required. For example, in the case where an L.P. indicator 52 is located in the tractor's cab or near the driver's-side door, a quick-disconnect connector may be included in the signal conduit 56 so that the conduit 56 may be separated when the trailer is unhitched from the tractor.

Figure 8:
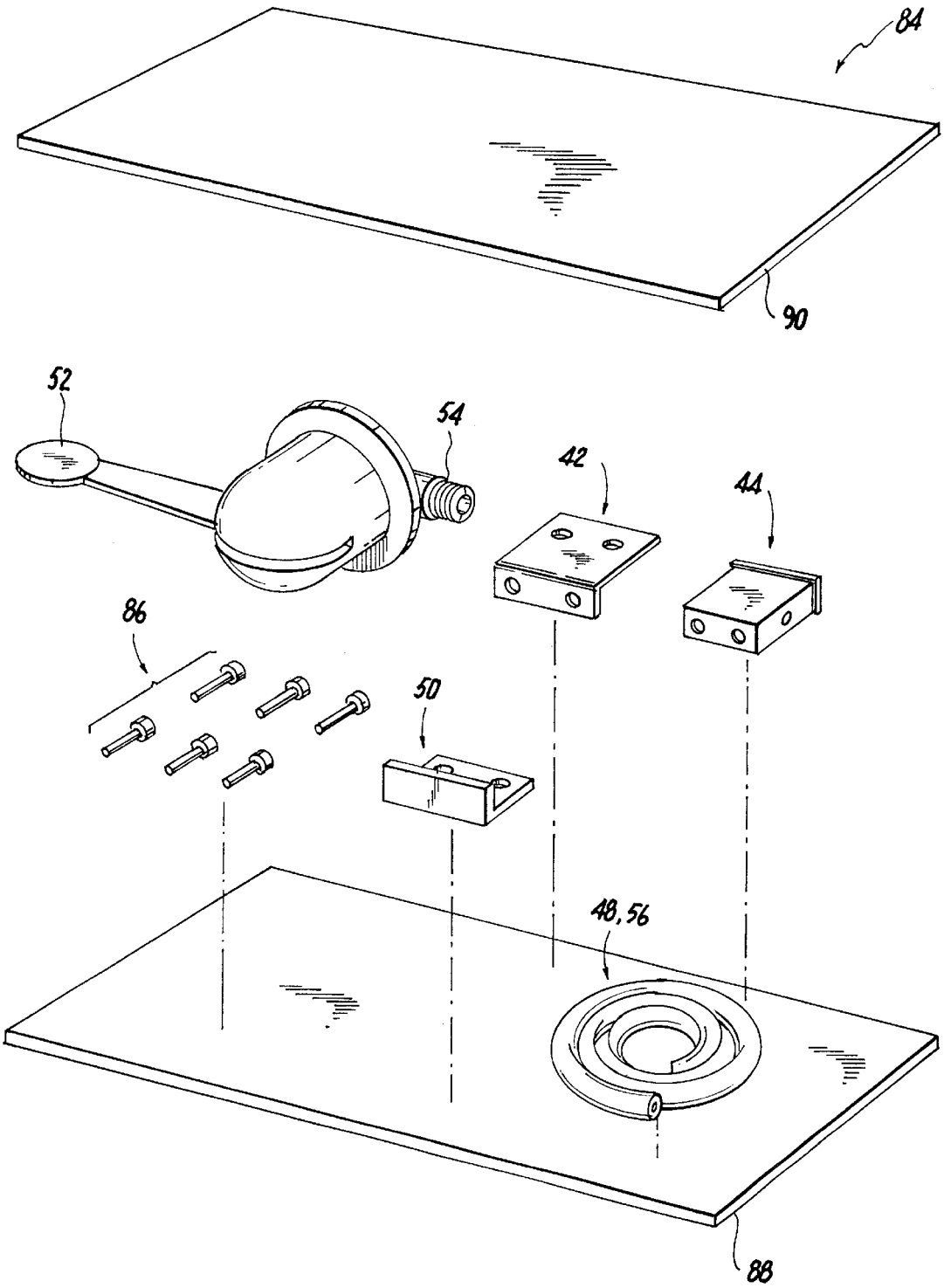
FIG. 8 is a perspective view of a kit for marketing an embodiment of the present invention.

Referring to FIG. 8, an embodiment of the present invention is illustrated as part of a kit 84. The kit 84 is a convenient way in which embodiments of the present invention may be marketed. Included in the kit 84 is the L.P. indicator 52, mounting bracket 42, valve 44, supply and signal conduit 48 and 56, contactor structure 50, and associated hardware 86. The kit 84 may be packaged as follows. The contents of the kit 84 are positioned on a base board 88 and sealed in position with a clear plastic overlay 90 utilizing vacuum-packing methods that are well known in the art. Of course, those skilled in the art will recognize the numerous other packaging systems that may be used to package the contents, for example, boxes with inserts, plastic or paper bags, etc.

In view of the above, it is clear that the above-described system may be used to warn an operator that a charge hopper of a concrete mixer is in the raised position. It is also clear that the system is relatively inexpensive and easy to install on new or used tractor-carried concrete mixers. Furthermore, it is clear that the system is easy to operate and maintain.

While the invention has been described with respect to preferred embodiments, those skilled in the art will readily appreciate that various changes and/or modifications can be made to the invention without departing from the spirit or scope of the invention as defined by the appended claims. It is noted that 35 U.S.C. § 112, paragraph 6, is not intended to be invoked unless a claim appended hereto, or otherwise added, specifically includes "means for" terminology.

What is claimed is:

1. In a concrete mixer including an air supply, a mixing drum having an access port, a frame supporting the mixing drum, and a charge hopper pivotally supported adjacent the access port and moveable between a raised position and a lowered position, the improvement comprising:

(a) an indicator device operatively associated with the concrete mixer and configured for activation to indicate when the charge hopper is in the raised position;

(b) a switching device operatively associated with the frame and the charge hopper and in fluid communication with the air supply and the indicator device, the switching device including an actuator moveable between a first position to deactivate the indicator device and a second position to activate the indicator device; and (c) a contact structure operatively associated with the frame and the charge hopper to actuate the switching device.

2. A concrete mixer as recited in claim 1, wherein the switching device is mounted on the frame and the contact structure is mounted on the charge hopper.

3. A concrete mixer as recited in claim 1, wherein the switching device is mounted on the charge hopper and the contact structure is mounted on the frame.

4. A concrete mixer as recited in claim 1, wherein the switching device is a two-position, three-port pneumatic valve.

5. A concrete mixer as recited in claim 1, wherein pressurized air is transmitted from the air supply to the indicator device when the actuator is in the first position.

6. A concrete mixer as recited in claim 1, wherein pressurized air is transmitted from the air supply to the indicator device when the actuator is in the second position.

7. A concrete mixer as recited in claim 1, wherein the indicator device is a diaphragm-type indicator device.

8. A concrete mixer as recited in claim 1, wherein the indicator device is located in a cab of the concrete mixer and includes a warning arm configured to move into an operator's forward field of vision when the charge hopper is in the raised position.

* * * * *